US007159426B1

(12) United States Patent
Ghiran

(10) Patent No.: US 7,159,426 B1
(45) Date of Patent: Jan. 9, 2007

(54) QUICK CHANGE ASSEMBLY FOR HYDROFORMING PUNCHES

(75) Inventor: Mike M. Ghiran, Lake Orion, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/236,066

(22) Filed: Sep. 27, 2005

(51) Int. Cl.
*B21D 53/88* (2006.01)
*B21D 26/02* (2006.01)

(52) U.S. Cl. ..... 72/55; 83/698.91; 29/421.1

(58) Field of Classification Search ..... 72/55, 72/58, 60, 61, 370.22; 83/698.31, 698.91; 29/421.1
See application file for complete search history.

(56) References Cited

U.S. PATENT DOCUMENTS 3,114,280 A * 12/1963 Schott ..... 83/698.91
3,715,947 A * 2/1973 Weisbeck et al. ..... 83/698.91
5,996,455 A * 12/1999 Haag et al. ..... 72/55
6,158,122 A * 12/2000 Skudutis ..... 29/421.1
6,260,393 B1 * 7/2001 Engel et al. ..... 72/55
6,591,648 B1 * 7/2003 Ash et al. ..... 72/55

* cited by examiner

*Primary Examiner*—David Jones
(74) *Attorney, Agent, or Firm*—Laura C. Hargitt

(57) ABSTRACT

A punch assembly used with a hydroforming die includes a punch cylinder for mounting to the hydroforming die and having a movable rod. The punch assembly also includes a punch for piercing an opening in a tubular member disposed in the hydroforming die. The punch assembly further includes a quick change assembly interconnecting the rod of the punch cylinder and the punch for allowing the punch to be removably attached to the punch cylinder.

19 Claims, 13 Drawing Sheets

QUICK CHANGE ASSEMBLY FOR HYDROFORMING PUNCHES

TECHNICAL FIELD

The present invention relates generally to hydroforming and, more specifically, to a quick change assembly for hydroforming punches.

BACKGROUND OF THE INVENTION

It is known to form a cross-sectional profile of a tubular member by a hydro-forming process in which a fluid filled tubular blank is placed within a cavity of a die and then the die is closed so that the tubular blank is enclosed within the die. Fluid pressure is then increased inside the tubular member to expand the blank outwardly against the cavity of the die to provide a tubular product having a die formed cross-sectional profile.

During tube hydroforming, punches of various shapes and sizes are used to create necessary openings in the tubular member. Hydraulic cylinders activate the motion of the punches. A solid mechanical mounting between the punch and a cylinder rod is necessary in order to provide the required strength needed for the piercing operation.

As the request for hydroformed tube applications grows, the need for higher number of opening or hole piercing also increases. Tubular members are not only designed with more openings, but the production number of parts is constantly increasing. As a result, punch resharpening and the time needed to replace dull punches in the die are becoming more important. However, the methods currently used to replace a punch in the die, requires the dismount of the hydraulic cylinder and/or the dismount of die inserts in the area of the punch needing replacement. This operation will also require the disconnection of hydraulic lines and, in most cases, the die will have to be outside of the press. The procedure is highly time consuming and is effecting production in a very negative way.

As a result, it is desirable to provide quick change of hydroforming punches during the hydroforming piercing process. It is also desirable to provide a less time consuming way of changing punches during the hydroforming piercing process. It is further desirable to change punches in a hydroforming die during piercing process. Therefore, there is a need in the art to provide a new quick change assembly for a hydroforming punch that meets these desires.

SUMMARY OF THE INVENTION

Accordingly, the present invention is a punch assembly used with a hydroforming die including a punch cylinder for mounting to the hydroforming die and having a movable rod. The punch assembly also includes a punch for piercing an opening in a tubular member disposed in the hydroforming die. The punch assembly further includes a quick change assembly interconnecting the rod of the punch cylinder and the punch for allowing the punch to be removably attached to the punch cylinder.

One advantage of the present invention is that a quick change assembly is provided for a hydroforming punch that allows for quick changing of the punches in the hydroforming die during piercing in an effortless manner and in a very short time while the die is still in the press. Another advantage of the present invention is that the quick change assembly improves quality of an opening created during a hydroforming piercing process due to the ability to change punches as needed. Yet another advantage of the present invention is that the quick change assembly reduces down time during the hydroforming piercing process. Still another advantage of the present invention is that the quick change assembly uses less manpower during the hydroforming piercing process. A further advantage of the present invention is that the quick change assembly allows for a significant improvement in uninterrupted production run during hydroforming. Yet a further advantage of the present invention is that the quick change assembly provides a better part maintenance in the hydroforming piercing process. Still a further advantage of the present invention is that the quick change assembly results in a significant cost reduction of between 95% and 98%.

Other features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
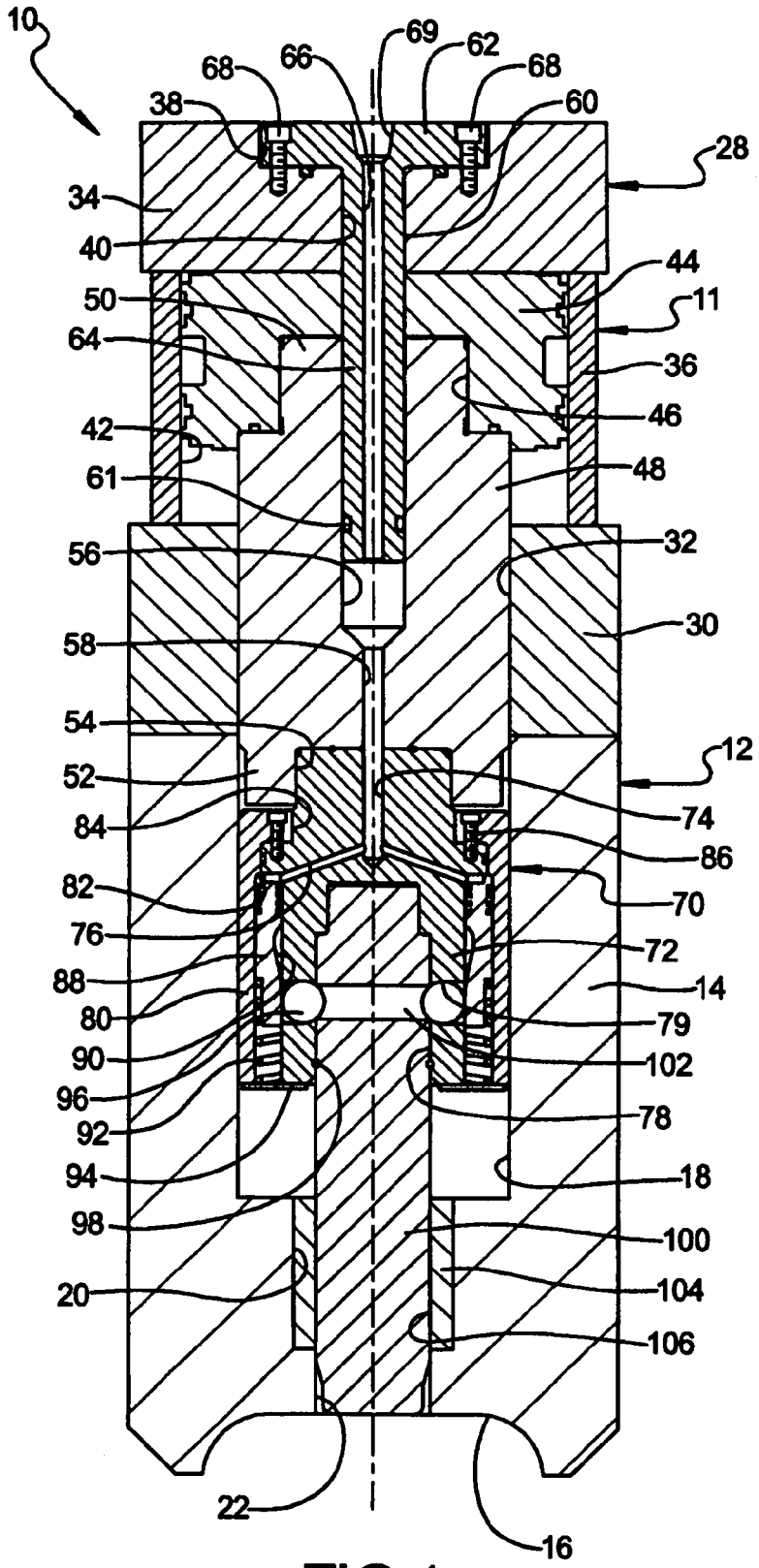
FIG. 1 is a fragmentary elevational view of a quick change assembly, according to the present invention, illustrated in operational relationship with a hydroforming punch assembly.

Referring to the drawings and in particular FIG. 1, one embodiment of a quick change assembly 10, according to the present invention, is generally shown for a punch assembly, generally indicated at 11, used with a hydroforming die, generally indicated at 12. The hydroforming die 12 is a die set comprised of a lower die half (not shown) and an upper die half 14. The lower die half and the upper die half 14 each include a tubular forming cavity portion 16. The upper die half 14 includes a first cavity 18 extending axially therein, a second cavity 20 extending axially from the first cavity 18 and having a diameter less than a diameter of the first cavity 18, and an aperture 22 extending axially from the second cavity 20 and therethrough to the tubular forming cavity portion 16. It should be appreciated that a combined cross-sectional circumferential measure of the tubular forming cavity portions total up to generally equal to or slightly greater than the cross-section of a tubular member (not shown).

The punch assembly 11 includes a punch cylinder, generally indicated at 28, supported upon the upper die half 14. The punch cylinder 28 includes a first end member 30 attached to the upper die half 14 by a suitable mechanism such as fasteners (not shown). The first end member 30 has a generally rectangular shape and has an aperture 32 extending axially therethrough to communicate with the first cavity 18 of the upper die half 14. The punch cylinder 28 also includes a second end member 34 spaced axially from the first end member 30 and a cylinder wall 36 extending axially between the first end member 30 and the second end member 34. The second end member 34 has a generally rectangular shape. The second end member 34 has a recess 38 extending axially therein and an aperture 40 extending axially therethrough and communicating with the recess 38. The cylinder wall 36 is generally annular to form a chamber 42 between the end members 30,34.

The punch cylinder 28 also includes a piston 44 disposed within the chamber 42 and movable axially therein. The piston 44 is generally cylindrical in shape and has a cavity 46 extending axially therein.

The punch cylinder 28 includes a rod 48 cooperating with the piston 44. The rod 48 is generally cylindrical in shape and has a first end 50 of a reduced diameter disposed in the cavity 46 of the piston 44. The rod 48 extends axially through the aperture 32 of the first end member 30 and has a second end 52 with a recess 54 extending axially therein. The rod 48 has a cavity 56 extending axially therein opposite the recess 54 and an aperture 58 extending axially from the cavity 56 to the recess 54. It should be appreciated that the rod 48 is provided in the center with the cavity 56 large enough to allow no interference with a guide member 60 to be described, yet be able to allow sealing in between a seal 61 and the cavity 56.

The punch cylinder 28 includes a guide member 60 to guide the travel of the piston 44 and rod 48. The guide member 60 has a head portion 62 extending radially and a shaft portion 64 extending axially from the head portion 62. The head portion 62 has a diameter greater than a diameter of the shaft portion 64. The head portion 62 is disposed in the recess 38 in the second end member 34 and the shaft portion 64 extends through the aperture 40 in the second end member 34. The guide member 60 has an aperture 66 extending axially therethrough for a function to be described. The guide member 60 is secured to the second end member 34 by a suitable mechanism such as fasteners 68. It should be appreciated that the guide member 60 is attached through the center of the punch cylinder 28 and is provided with the aperture 66 through the center and an enlarged fitting opening 69 at the end for hydraulic or pneumatic supply. It should also be appreciated that the piston 44 and rod 48 are movable relative to the guide member 60.

The punch assembly 11 further includes the quick change assembly 10. The quick change assembly 10 includes a quick change cylinder, generally indicated at 70, supported by the rod 48 of the punch cylinder 28 within the upper die half 14. The quick change cylinder 70 is disposed within the cavity 18 of the upper die half 14. The quick change cylinder 70 includes a guide member 72 extending axially and having one end disposed in the cavity 54 of the rod 48 by a suitable mechanism such as press-fitting. The guide member 72 is generally cylindrical in shape and has a central aperture 74 extending axially therein and a pair of branch apertures 76 extending outwardly and downwardly at an angle from the central aperture 74. The guide member 72 has a cavity 78 extending axially therein and an aperture 79 extending radially therethrough and communicating with the cavity 78 for a function to be described.

The quick change cylinder 70 also includes a cylinder wall 80 disposed about the guide member 72. The cylinder wall 80 is generally annular and extends axially to form a chamber 82. The cylinder wall 80 has an aperture 84 extending through one end to allow the guide member 72 to extend therethrough. The cylinder wall 80 is connected to the guide member 72 by a suitable mechanism such as fasteners 86.

The quick change cylinder 70 includes a piston 88 disposed within the chamber 82 and movable axially therein. The piston 88 is generally cylindrical in shape and has a groove or recess 90 extending radially therein for a function to be described. It should be appreciated that fluid activates the piston 88 therein.

The quick change assembly 10 also includes a spring 92 disposed within the chamber 82. The spring 92 is of a coil type. The spring 92 urges the piston 88 toward the rod 48. The quick change assembly 10 further includes a front cover plate 94 closing an end of the chamber 82. The front cover plate 94 is generally annular and secured to the end of the guide member 72 and cylinder wall 80 by a suitable mechanism such as fasteners (not shown). It should be appreciated that the spring 92 extends axially between the piston 88 and the front cover plate 94. It should also be appreciated that the quick change cylinder 70 may be a hydraulic or pneumatic cylinder.

The quick change assembly 10 further includes a plurality of balls 96, preferably four balls 96. The balls 96 are disposed in the aperture 79 of the guide member 72. The balls 96 are generally spherical in shape. The quick change assembly 10 may include a wiper seal 98 spaced axially between the balls 96 and the front cover plate 94 and disposed in a groove of about the cavity 78 of the guide member 72 to prevent contamination. It should be appreciated that the aperture 79 is configured to prevent the balls 96 from exiting the aperture 79 into the cavity 78 of the guide member 72.

The punch assembly 11 includes a punch 100 for forming an opening in the tubular member. The punch 100 extends axially and is generally cylindrical in shape. The punch 100 has an annular groove 102 extending radially therein near one end thereof. The end of the punch 100 is disposed in the cavity 78 of the quick change cylinder 70 such that the balls 96 are disposed in the groove 102. It should be appreciated that, in this position, the wiper seal 98 is disposed about and contacts the punch 100. It should also be appreciated that the balls 96 retain or release the punch 100 in the quick change assembly 10 by engaging and disengaging the groove 102 of the punch 100.

The punch assembly 11 further includes a guide bushing 104 to guide the punch 100. The guide bushing 104 extends axially and is generally annular. The guide bushing 104 has an aperture 106 extending axially therethrough. The guide bushing 104 is disposed in the cavity 20 of the upper die half 14. It should be appreciated that the punch 100 extends through the aperture 106 of the guide bushing 104 for sliding contact therewith.

Referring to FIG. 1, the punch assembly 11 is illustrated with the punch 100 in a retracted position. Upon completion of hydroforming, the tubular member (not shown) is in intimate contact with the wall of the cavity portion 16 of the upper die half 14. The hydroforming fluid is pressurized to a forming pressure of approximately 10,000-psi. At this time, the tubular member is formed and takes the shape of the die cavity by becoming in intimate contact with all die cavity surfaces.

Figure 2:
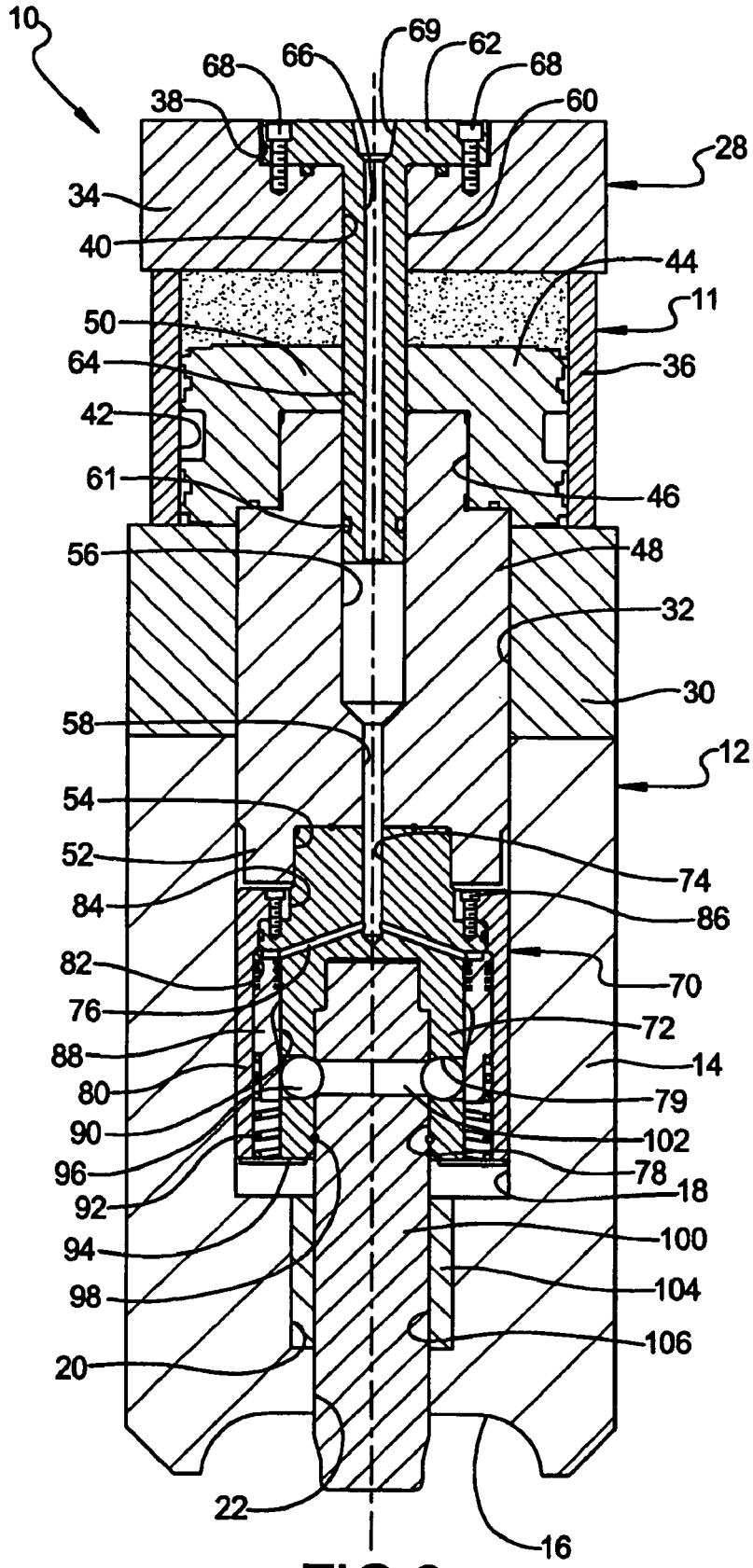
FIG. 2 is a view similar to FIG. 1 illustrating a first step of a punch removal process.

When the punch cylinder 28 is actuated, the punch 100 will advance and pierce the wall of the tubular member (not shown) as illustrated in FIG. 2. After the wall of the tubular member is pierced by the front of the punch 100, the forward motion of the punch 100 will shear a slug (not shown) and form the opening in the tubular member.

Figure 3:
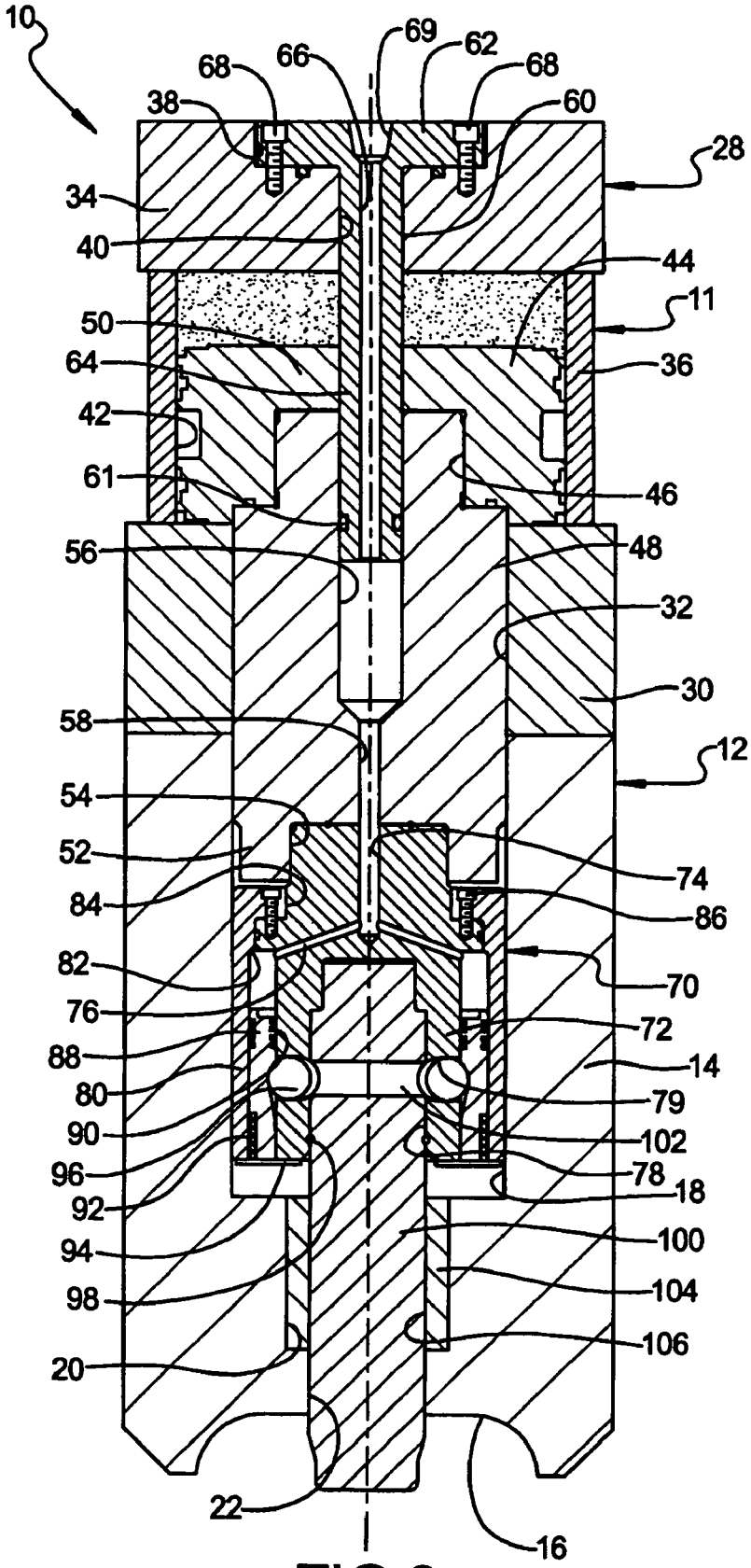
FIG. 3 is a view similar to FIG. 1 illustrating a second step of a punch removal process.
Figure 4:
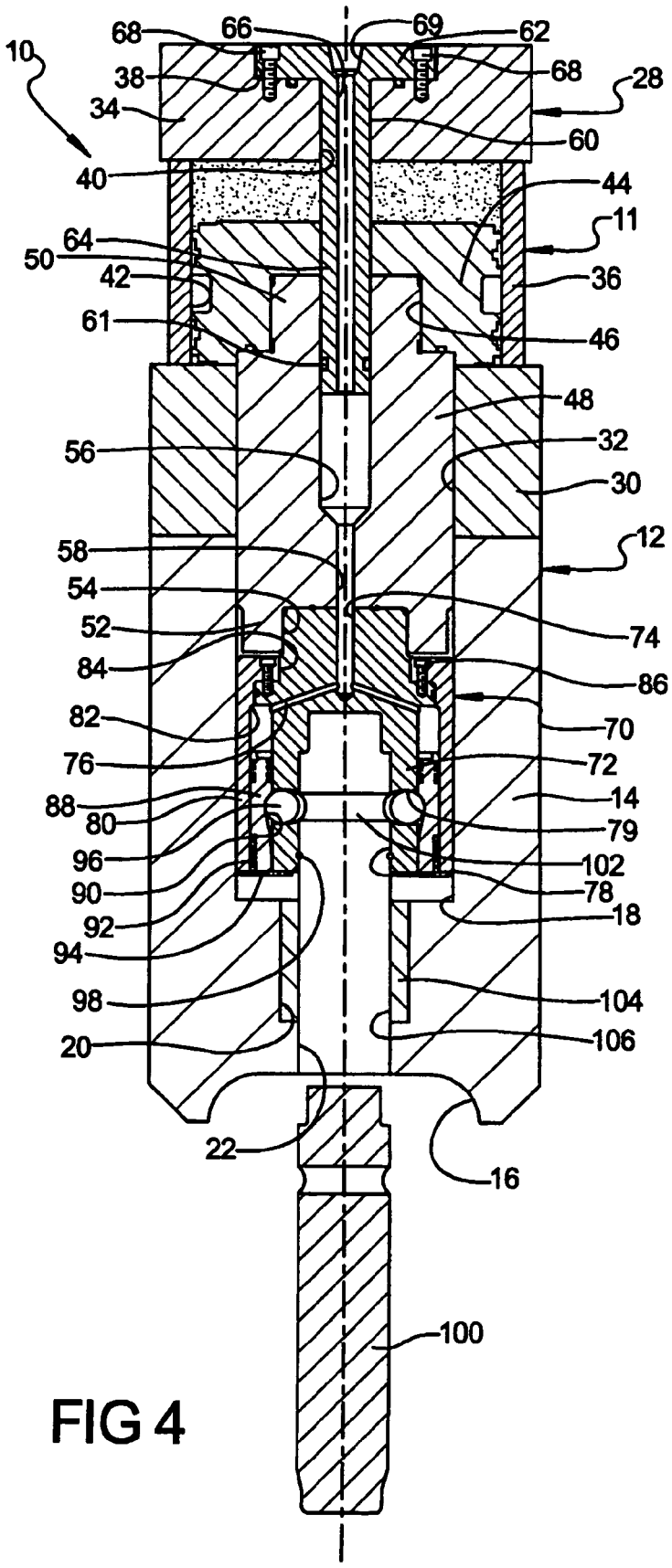
FIG. 4 is a view similar to FIG. 1 illustrating a third step of a punch removal process.

After the opening is formed in the tubular member, the punch cylinder 28 is actuated to retract the punch 100 from the tubular member. If the punch 100 is to be changed, fluid through the quick change cylinder 70 will advance the piston 88 forward and release the tension on the balls 96, allowing removal of the punch 100 as illustrated in FIGS. 3 and 4. It should be appreciated that the return travel of the piston 88 is activated by the spring 92 after the hydraulic or pneumatic pressure is no longer active. It should also be appreciated that the forward and backward motion of the piston 88 will allow the balls 96 to move in or out of the groove 90 of the piston 88.

Referring to FIGS. 5 through 9, another embodiment, according to the present invention, of the quick change assembly 10 and punch assembly 11 is shown. Like parts of the quick change assembly 10 and the punch assembly 11 have like reference numerals increased by one hundred (100). In this embodiment, the punch assembly 111 includes the quick change assembly 110. The punch assembly 111 includes a punch cylinder, generally indicated at 128, supported upon the upper die half 14. The punch cylinder 128 includes a first end member 130 attached to the upper die half 14 by a suitable mechanism such as fasteners (not shown). The first end member 130 has a generally rectangular shape and has an aperture 132 extending axially therethrough to communicate with the first cavity 18 of the upper die half 14. The punch cylinder 128 also includes a second end member 134 spaced axially from the first end member 130 and a cylinder wall 136 extending axially between the first end member 130 and the second end member 134. The second end member 134 has a generally rectangular shape. The cylinder wall 136 is generally annular to form a chamber 142.

The punch cylinder 128 includes a piston 144 disposed within the chamber 142 and movable axially therein. The piston 144 is generally cylindrical in shape and has a cavity 146 extending axially therein.

The punch cylinder 128 includes a rod 148 cooperating with the piston 144. The rod 148 is generally cylindrical in shape and has a first end 150 of a reduced diameter disposed in the cavity 146 of the piston 144. The rod 148 extends axially through the aperture 132 of the first end member 130 and has a second end 152.

The punch assembly 111 includes a punch 200 for forming an opening in the tubular member. The punch 200 extends axially and is generally cylindrical in shape. The punch 200 has a head 201 and an annular groove 202 extending radially therein near the head 201. The punch 200 also has a planar surface or flat 203 on one side near the back end. The head 201 of the punch 200 is operatively attached to the rod 148 of the punch cylinder 128 by a bracket 213 to be described. It should be appreciated that the flat 203 on the punch 200 is in close proximity with a face of an anti-rotation block 219 to be described.

The punch assembly 111 also includes a guide bushing 204 to guide the punch 200. The guide bushing 204 extends axially and is generally annular. The guide bushing 204 has an aperture 206 extending axially therethrough. The guide bushing 204 is disposed in the cavity 20 of the upper die half 14. It should be appreciated that the punch 200 extends through the aperture 206 of the guide bushing 204 for sliding contact therewith.

The quick change assembly 110 includes a solid bracket 213 having a thread end 215. The threaded end 213 is mounted to the rod 148 of the hydraulic cylinder 128. The bracket 213 has a generally "T" shaped slot 217 formed therein at the end opposite the threaded end 215 to engage a corresponding "T" shaped configuration formed by the head 201 and groove 202 of the punch 200.

The quick change assembly 110 also includes an anti-rotation block 219 to prevent rotation of the punch 200. The block 219 is generally "L" shaped. The block 219 has a threaded cavity 221 extending therein. The block 219 also has a handle 223 attached thereto. It should be appreciated that a face of the block 219 is in close proximity to the flat 203 on the punch 200.

The quick change assembly 110 further includes a fastener 224 for removably fastening the block 219 to the upper die half 14. The fastener 224 is of a screw type. It should be appreciated that the block 219 is secured in position by the fastener 224, which will allow the punch 200 to move up and down, but at the same time will restrict its rotation.

Figure 5:
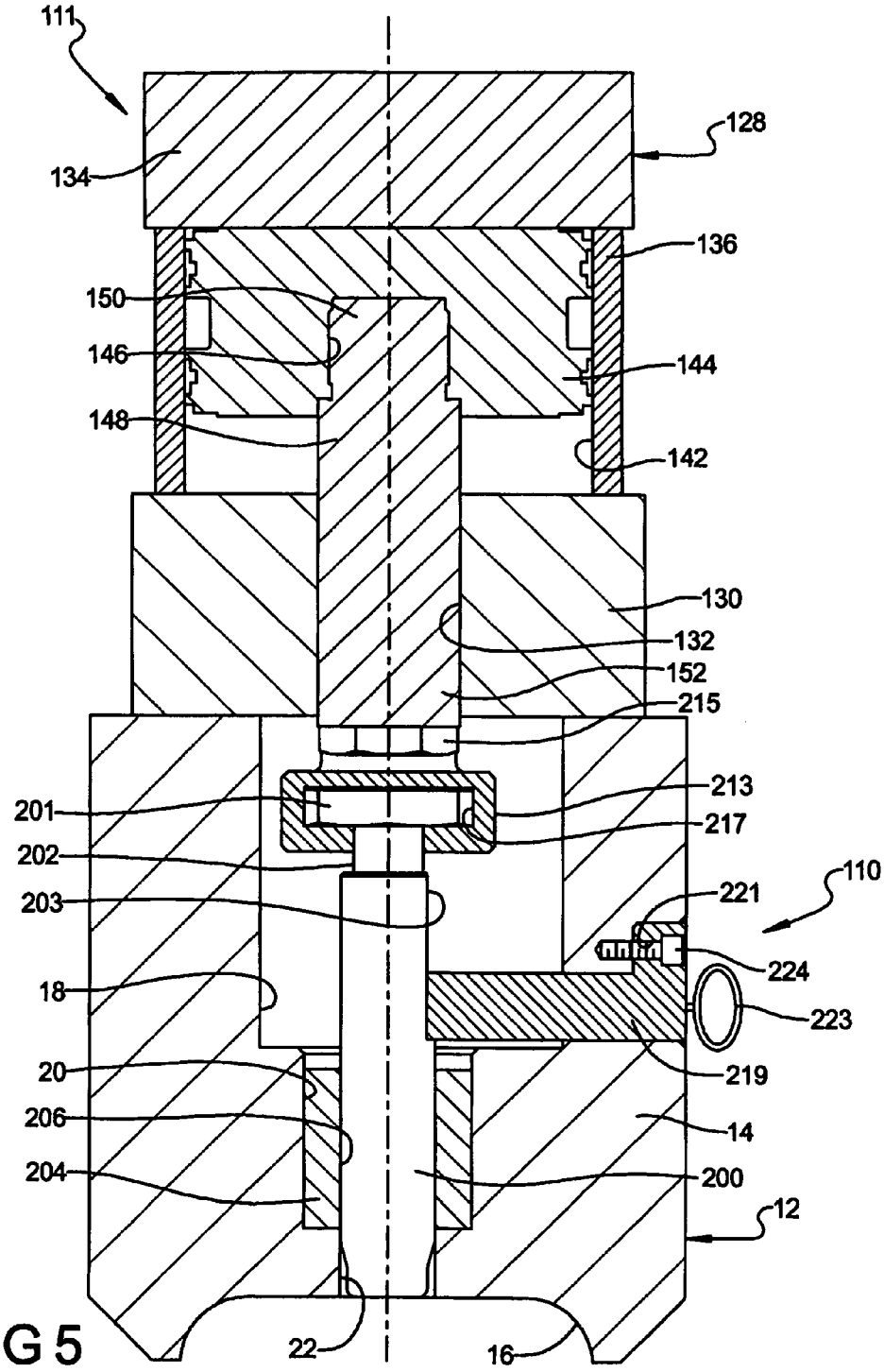
FIG. 5 is a fragmentary elevational view of another embodiment, according to the present invention, of the quick change assembly of FIG. 1 illustrated in operational relationship with a hydroforming punch assembly.

Referring to FIG. 5, the punch assembly 111 is illustrated with the punch 200 in a retracted position. Upon completion of hydroforming, the tubular member (not shown) is in intimate contact with the wall of the cavity portion 16 of the upper die half 14. The hydroforming fluid is pressurized to a forming pressure of approximately 10,000-psi. At this time, the tubular member is formed and takes the shape of the die cavity by becoming in intimate contact with all die cavity surfaces.

Figure 6:
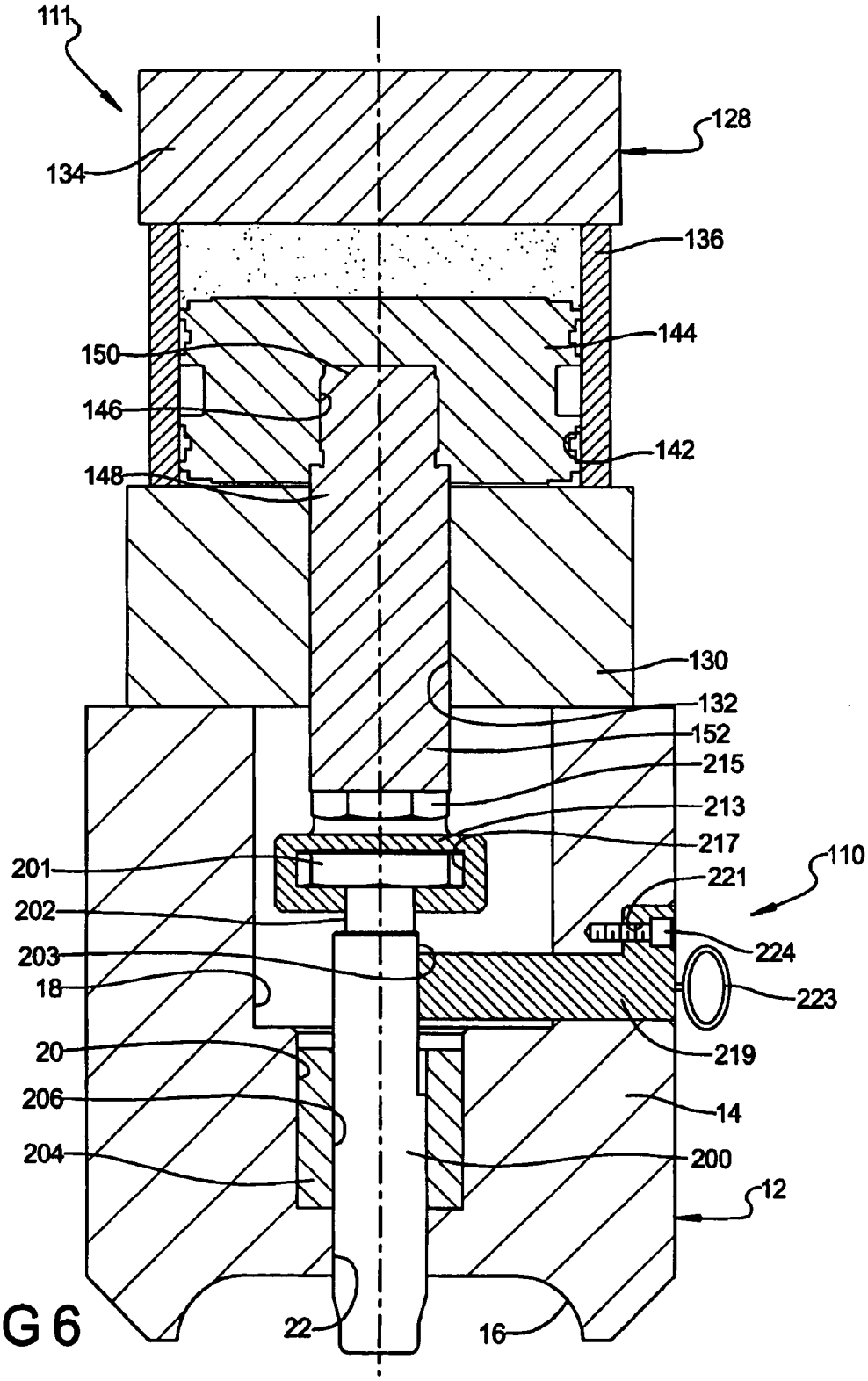
FIG. 6 is a view similar to FIG. 5 illustrating a first step of a punch removal process.

When the punch cylinder 128 is actuated, the punch 200 will advance and pierce the wall of the tubular member (not shown) as illustrated in FIG. 6. After the wall of the tubular member is pierced by the front of the punch 200, the forward motion of the punch 200 will shear a slug (not shown) and form the opening in the tubular member.

Figure 7:
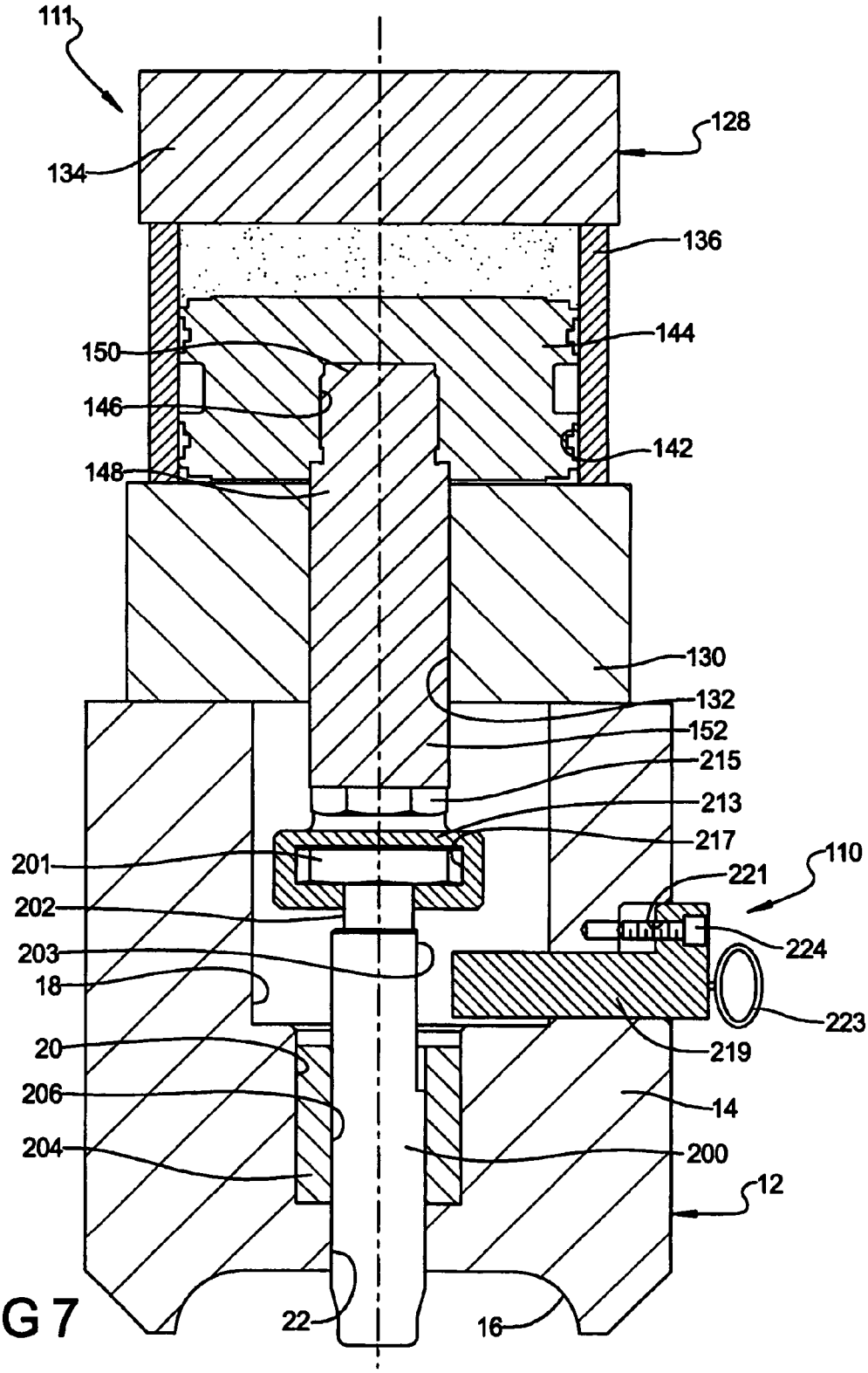
FIG. 7 is a view similar to FIG. 5 illustrating a second step of a punch removal process.
Figure 8:
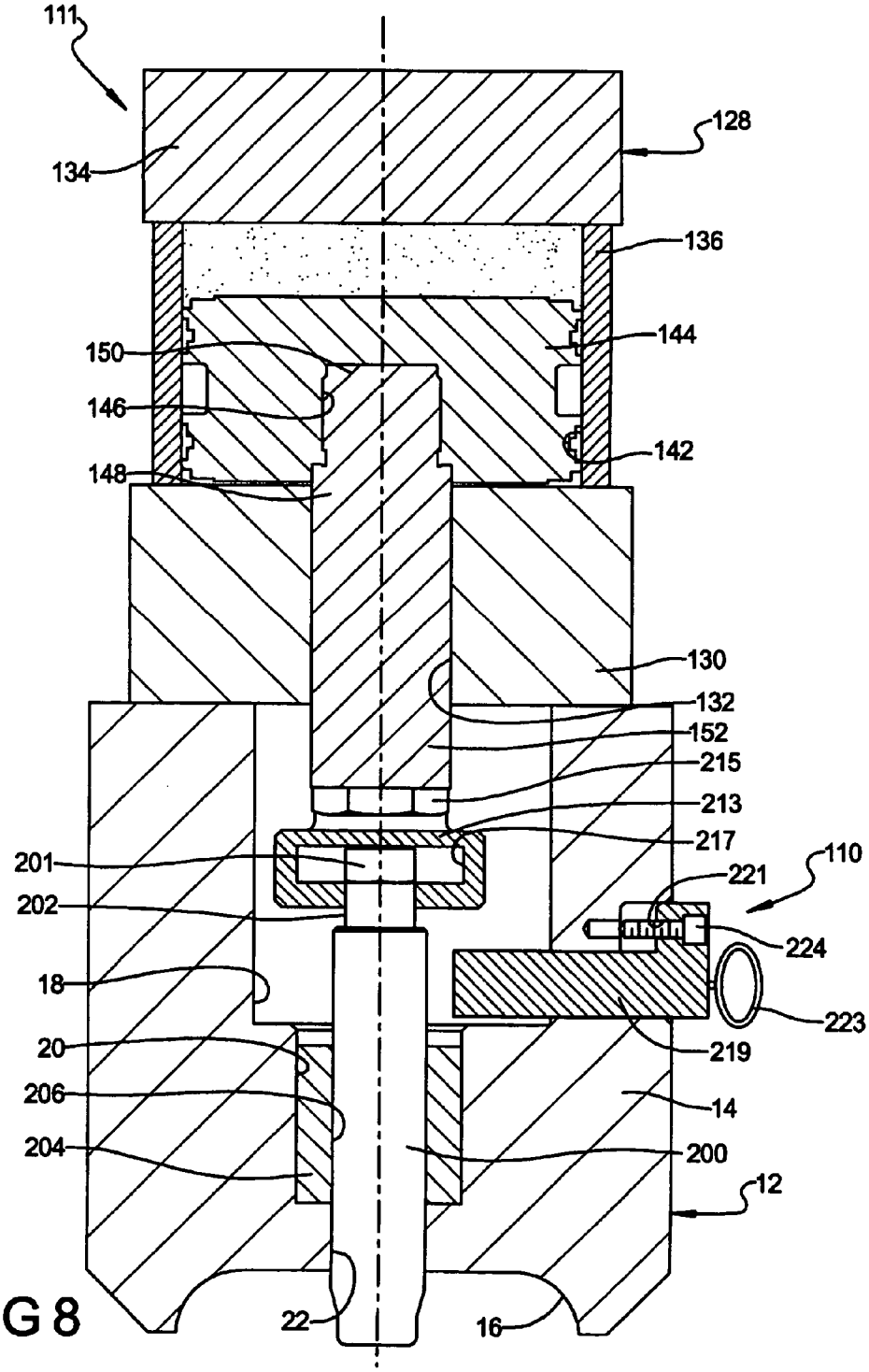
FIG. 8 is a view similar to FIG. 5 illustrating a third step of a punch removal process.
Figure 9:
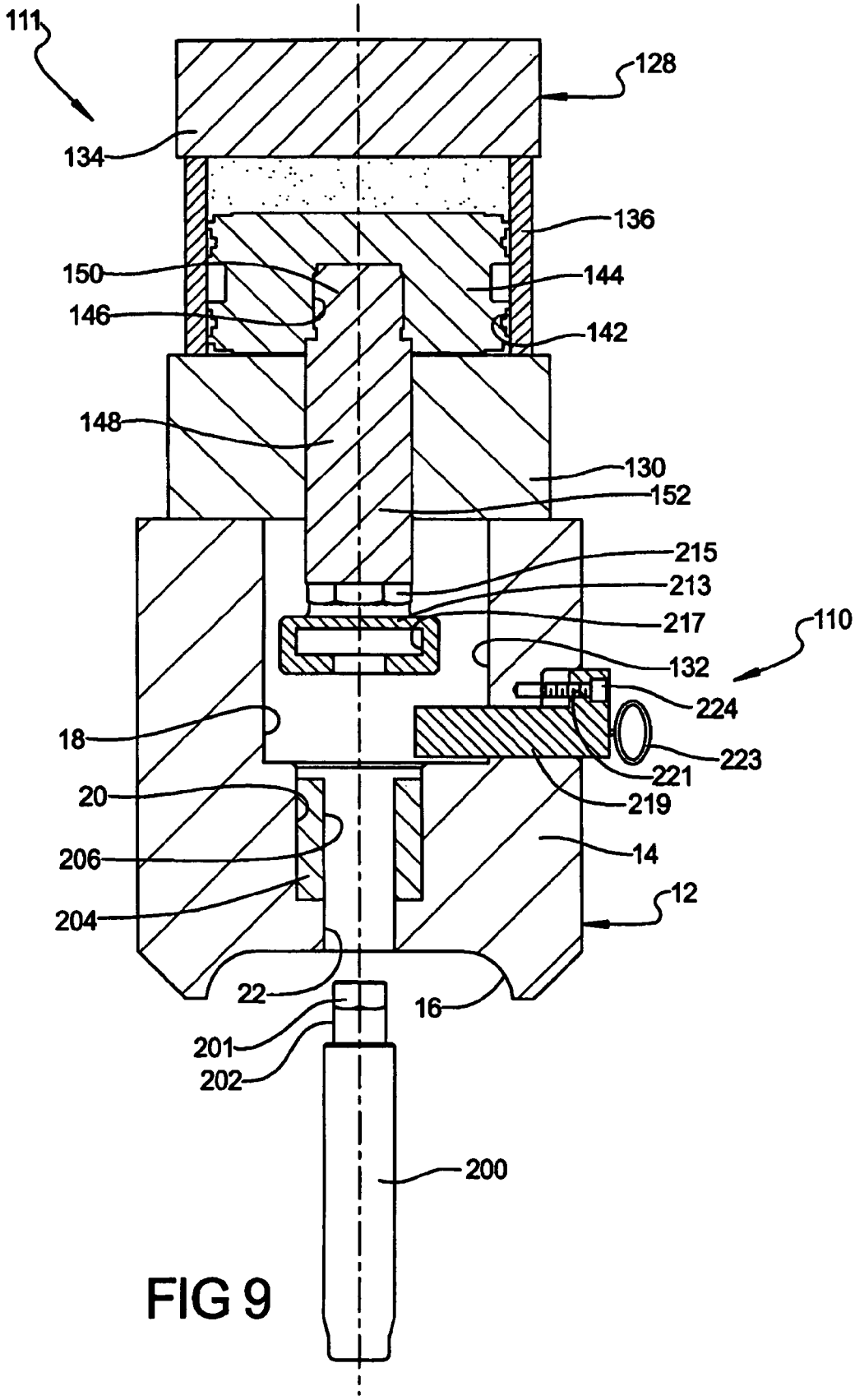
FIG. 9 is a view similar to FIG. 5 illustrating a third step of a punch removal process.

After the opening is formed in the tubular member, the punch cylinder 128 is actuated to retract the punch 200 from the tubular member. If the punch 200 is to be changed, the punch 200 is held in the advanced position, and the fastener 224 is released and the block 219 is retracted as illustrated in FIG. 7. This condition allows the punch 200 to be rotated or turned by hand approximately ninety degrees (90°), providing clearance between the bracket 213 and the head 201 of the punch 200 as illustrated in FIG. 8. As illustrated in FIG. 9, the punch 200 is removed from the upper die half 14 to a removable position with the flat 203 (FIG. 7) forward and the head 201 of the punch 200 also in the removable position. It should be appreciated that the quick change assembly 110 is simpler to make and use than the quick change assembly 10.

Referring to FIGS. 10 through 13, yet another embodiment, according to the present invention, of the quick change assembly 10 is shown. Like parts of the quick change assembly 10 and punch assembly 11 have like reference numerals increased by 200. In this embodiment, the punch assembly 211 includes the quick change assembly 210. The punch assembly 211 includes a punch cylinder, generally indicated at 228, supported upon the upper die half 14. The punch cylinder 228 includes a first end member 230 attached to the upper die half 14 by a suitable mechanism such as fasteners (not shown). The first end member 230 has a generally rectangular shape and has an aperture 232 extending axially therethrough to communicate with the first cavity 18 of the upper die half 14. The punch cylinder 228 also includes a second end member 234 spaced axially from the first end member 230 and a cylinder wall 236 extending axially between the first end member 230 and the second end member 234. The second end member 234 has a generally rectangular shape. The cylinder wall 236 is generally annular to form a chamber 242.

The punch cylinder 228 includes a piston 244 disposed within the chamber 242 and movable axially therein. The piston 244 is generally cylindrical in shape and has a cavity 246 extending axially therein.

The punch cylinder 228 includes a rod 248 cooperating with the piston 244. The rod 248 is generally cylindrical in shape and has a first end 250 of a reduced diameter disposed in the cavity 246 of the piston 244. The rod 248 extends axially through the aperture 232 of the first end member 230 and has a second end 252.

The punch assembly 211 includes a punch 300 for forming an opening in the tubular member. The punch 300 extends axially and is generally cylindrical in shape. The punch 300 has a head 301 and an annular groove 302 extending radially therein near the head 301. The head 301 of the punch 300 is operatively attached to the rod 248 of the punch cylinder 228 by a coupling 307 and bracket 311 to be described.

The punch assembly 211 also includes a guide bushing 304 to guide the punch 300. The guide bushing 304 extends axially and is generally annular. The guide bushing 304 has an aperture 306 extending axially therethrough. The guide bushing 304 is disposed in the cavity 20 of the upper die half 14. It should be appreciated that the punch 300 extends through the aperture 306 of the guide bushing 304 for sliding contact therewith.

The quick change assembly 210 includes a coupling 307 having a thread end (not shown). The threaded end is mounted to the rod 248 of the punch cylinder 228. The coupling 307 also has a head 309 at an end opposite the threaded end and an annular groove extending radially therein near the head 301.

The quick change assembly 210 further includes a bracket 311 to connect the punch 300 to the coupling 307. The bracket 311 has a generally "T" shaped first slot 313 formed therein to engage a corresponding "T" shaped configuration formed by the head 309 and groove of the coupling 307. It should be appreciated that the first slot 313 allows easy sliding motion for the head 309 of the coupling 307.

The bracket 311 has a generally "T" shaped second slot 315 formed therein at the end opposite the first slot 313 to engage a corresponding "T" shaped configuration formed by the head 301 and groove (not illustrated) of the punch 300. The second slot 315 has a length less than a length of the first slot 313. The bracket 311 has a generally "T" shaped tongue 317 extending axially on one side for a function to be described. It should be appreciated that the mounting between the coupling 307, bracket 311, and punch 300 is fitted with enough clearance to allow easy in and out sliding movement of the bracket 311 in order to be able to disconnect the punch 300 from the bracket 311. It should also be appreciated that the coupling 307 and bracket 311 are the mounting mechanism between the rod 248 and the punch 300.

The quick change assembly 110 includes an anti-rotation block 319 to prevent rotation of the bracket 311. The block 319 is generally "L" shaped. The block 319 has a threaded cavity 321 extending therein. The block 319 also has a handle 323 attached thereto. The block 319 has a generally "T" shaped slot 325 formed therein at the end opposite the cavity 321 to engage the corresponding "T" shaped configuration of the tongue 317 of the bracket 311.

The quick change assembly 210 also includes a fastener 327 for removably fastening the block 319 to the upper die half 14. The fastener 327 is of a screw type. It should be appreciated that the block 319 is secured in position by the fastener 327, which will allow the bracket 311 to move up and down, but at the same time will restrict its rotation.

Figure 10:
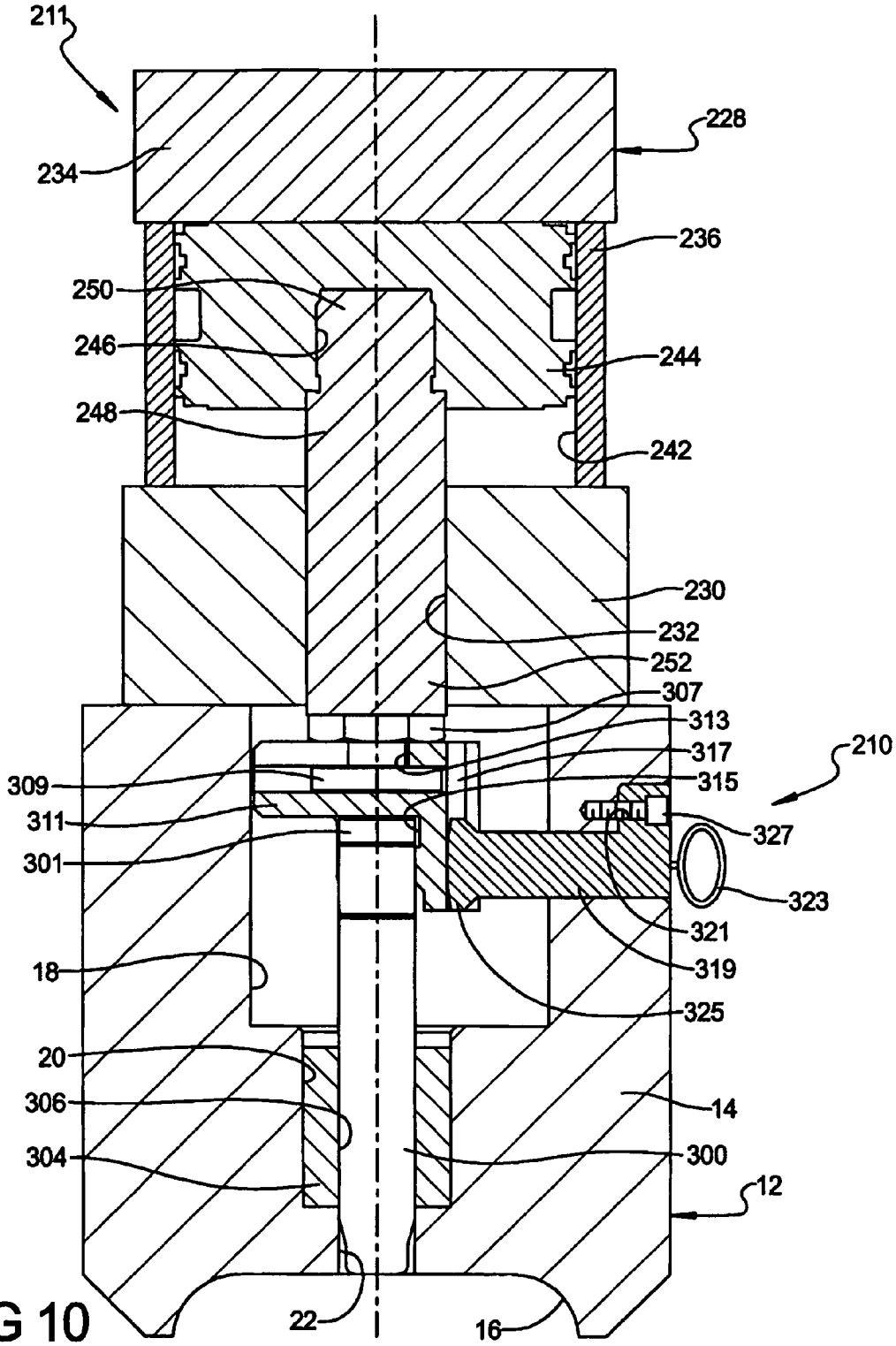
FIG. 10 is a fragmentary elevational view of yet another embodiment, according to the present invention, of the quick change assembly of FIG. 1 illustrated in operational relationship with a hydroforming punch assembly.

Referring to FIG. 10, the punch assembly 211 is illustrated with the punch 300 in a retracted position. Upon completion of hydroforming, the tubular member (not shown) is in intimate contact with the wall of the cavity portion 16 of the upper die half 14. The hydroforming fluid is pressurized to a forming pressure of approximately 10,000-psi. At this time, the tubular member is formed and takes the shape of the die cavity by becoming in intimate contact with all die cavity surfaces.

Figure 11:
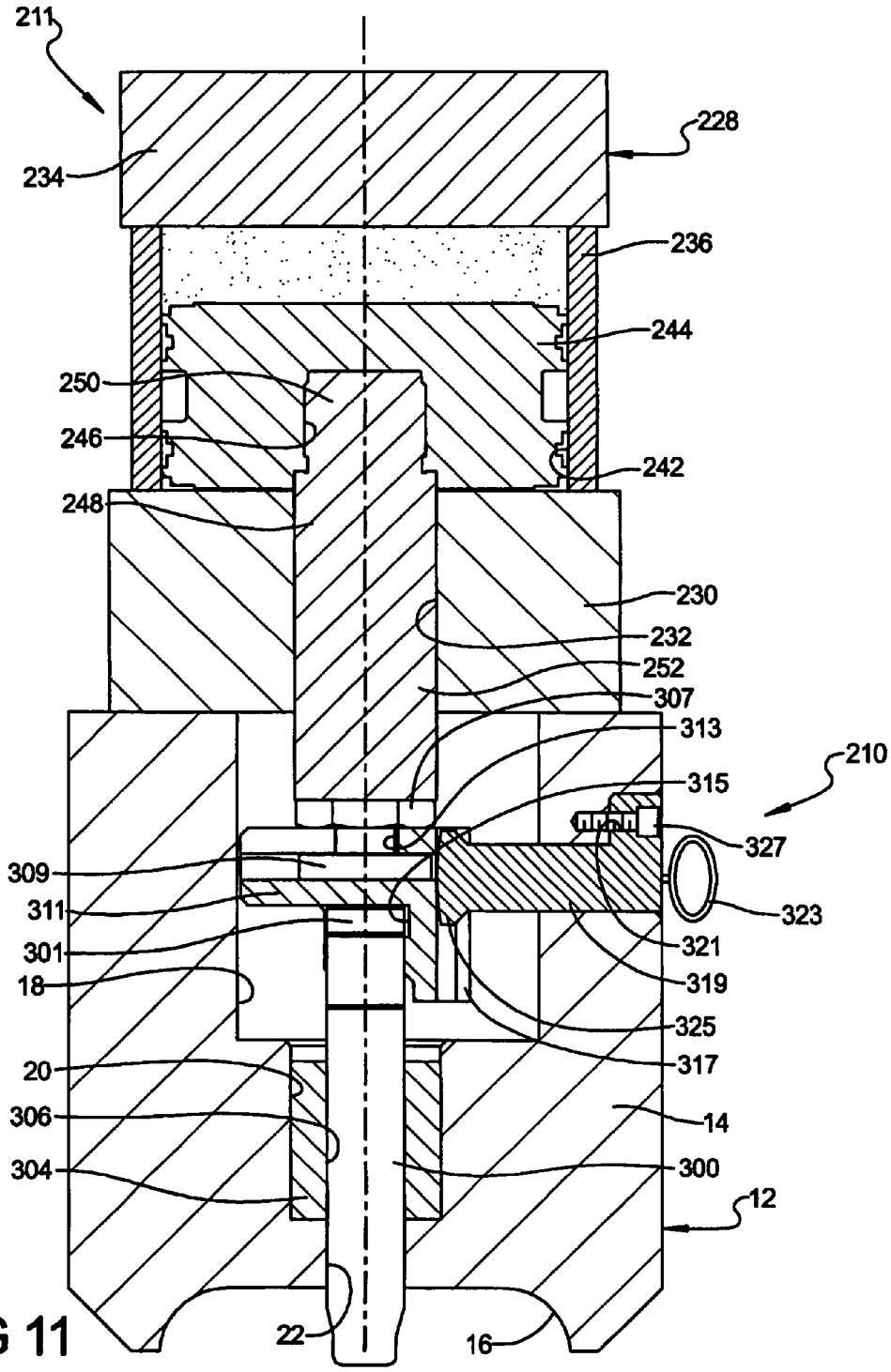
FIG. 11 is a view similar to FIG. 10 illustrating a first step of a hydroforming process.

When the punch cylinder 228 is actuated, the punch 300 will advance and pierce the wall of the tubular member (not shown) as illustrated in FIG. 11. After the wall of the tubular member is pierced by the front of the punch 300, the forward motion of the punch 300 will shear a slug (not shown) and form the opening in the tubular member. It should be appreciated that the engagement between the tongue 317 of the bracket 311 and the slot 325 of the block 319 allows an unobstructed in and out movement of the punch 300 during the piercing operation, yet keeps the bracket 311 aligned and engaged with the coupling 307 and the punch 300.

Figure 12:
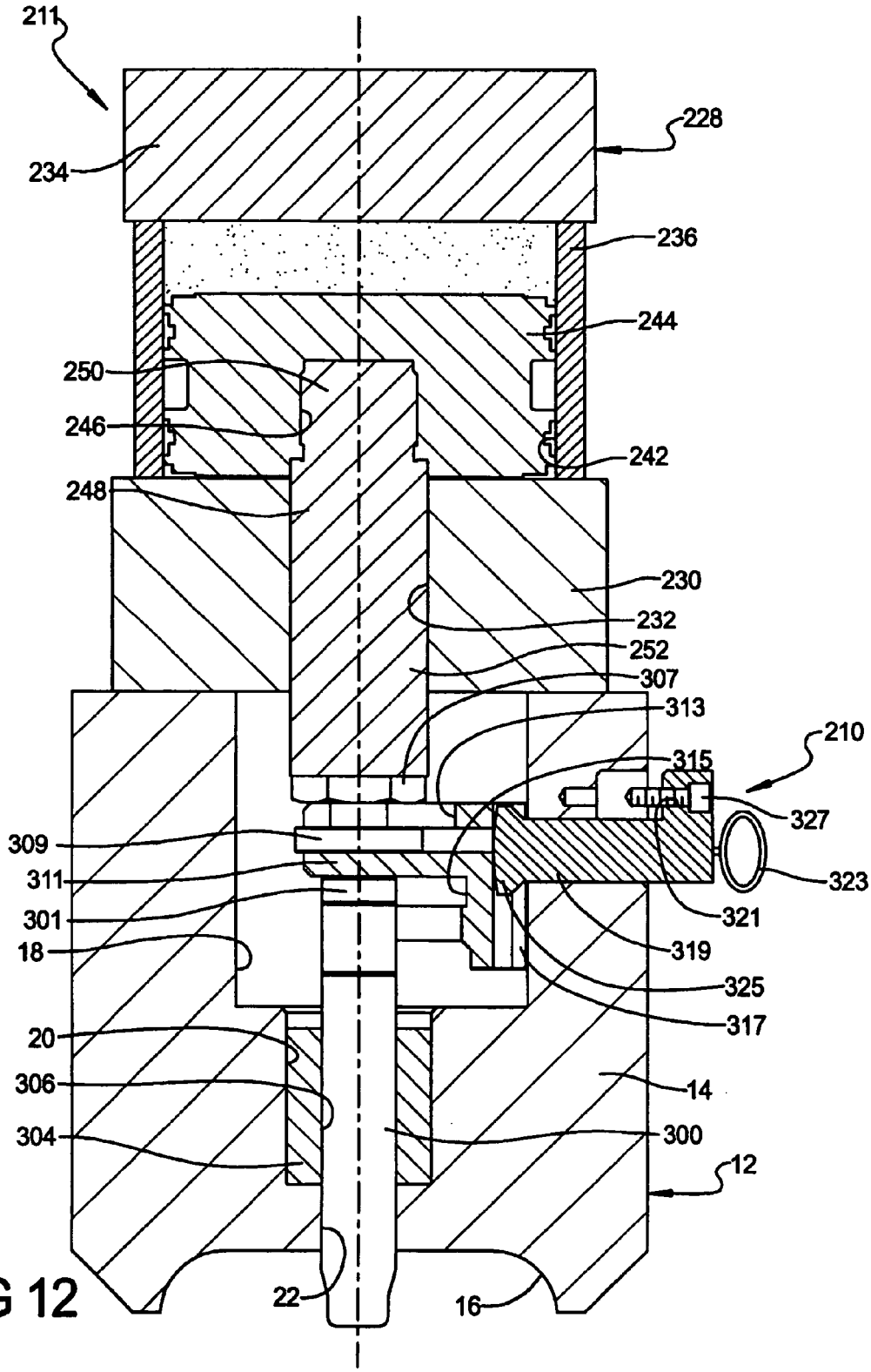
FIG. 12 is a view similar to FIG. 10 illustrating a second step of a punch removal process.
Figure 13:
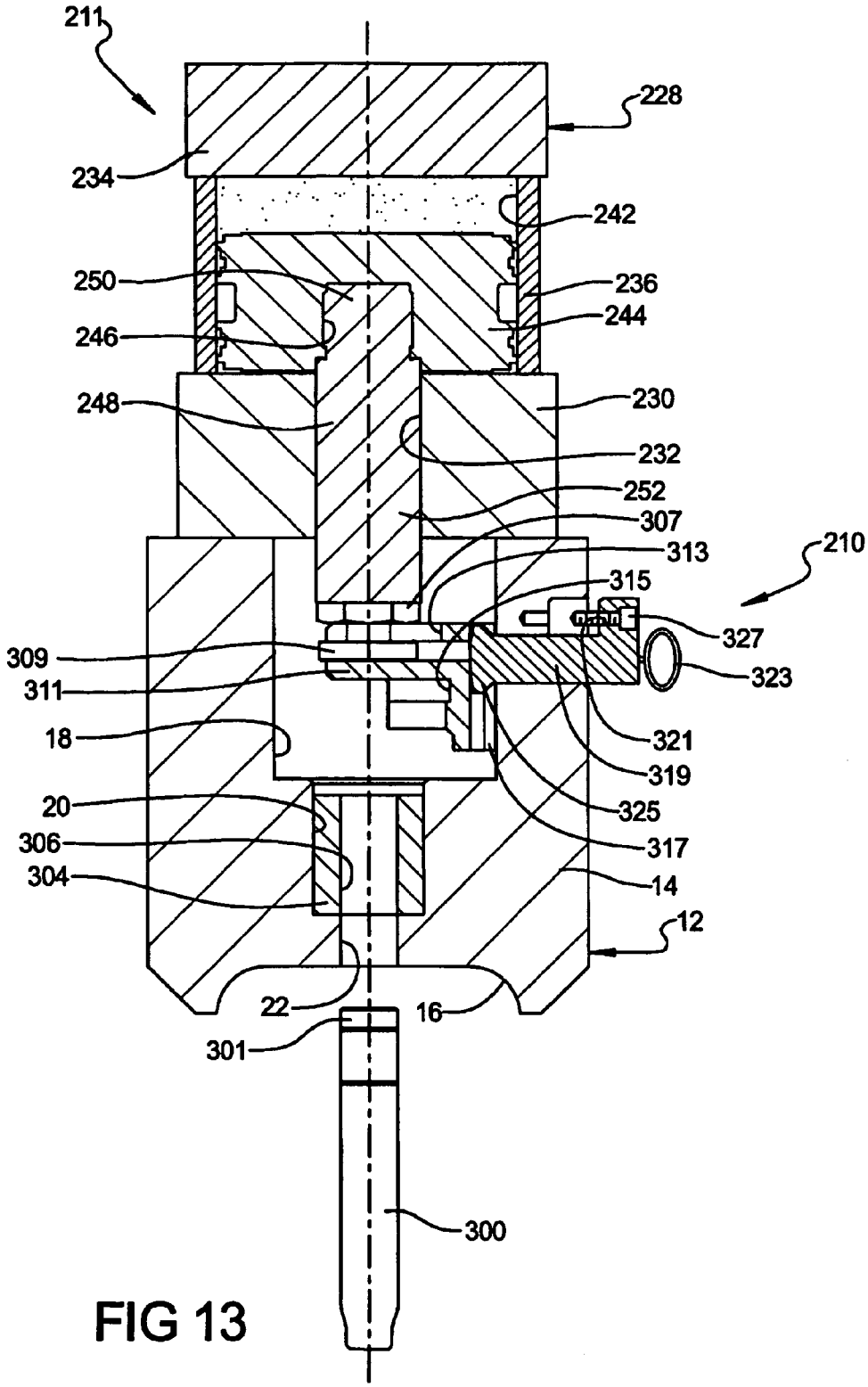
FIG. 13 is a view similar to FIG. 10 illustrating a third step of a punch removal process.

After the opening is formed in the tubular member, the punch cylinder 228 is actuated to retract the punch 300 from the tubular member. If the punch 300 is to be changed, the punch 300 is held in the advanced position, the fastener 327 is released, and the block 319 is retracted. At the end of the retracted movement of the bracket 311, the head 301 of the punch 300 is no longer engaged in the second slot 315 of the bracket 311 as illustrated in FIG. 12. As illustrated in FIG. 13, the punch 300 is removed from the upper die half 14 in a removable position. It should be appreciated that, at the same time, the head 309 of the coupling 307 remains engaged in the first slot 313 of the bracket 311 as a permanent condition. It should also be appreciated that, by removing the fastener 327, the block 319 also serves the function of pulling the bracket 311 away from the original position to allow the removal of the punch 300. It should further be appreciated that the quick change assembly 210 is directed toward oval punches or punches that cannot be turned before removal and must remain in the same radial position prior to being removed.

Accordingly, the quick change assemblies 10, 110, and 210 minimize the time for changing punches 100, 200, and 300, respectively, resulting in significant savings in manpower and down-time as well as improve quality.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

I claim:

1. A punch assembly used with a hydroforming die comprising:

a punch cylinder for mounting to the hydroforming die and having a movable rod;

a punch for piercing an opening in a tubular member disposed in the hydroforming die; and a quick change assembly interconnecting said rod of said punch cylinder and said punch for allowing said punch to be removably attached to said punch cylinder;

wherein said punch has a head portion extending radially and a shaft portion extending axially from said head portion and having a groove extending radially therein.

2. A punch assembly as set forth in claim 1 wherein said quick change assembly comprises a quick change cylinder supported by said rod of said punch cylinder.

3. A punch assembly as set forth in claim 2 wherein said quick change cylinder includes a guide member extending axially and having one end attached to said rod.

4. A punch assembly as set forth in claim 3 wherein said quick change cylinder includes a cylinder wall disposed about said guide member to form a chamber.

5. A punch assembly as set forth in claim 4 wherein said quick change cylinder includes a movable piston disposed within said chamber.

6. A punch assembly as set forth in claim 5 wherein said quick change cylinder includes a spring disposed within said chamber to urge said piston toward said rod.

7. A punch assembly as set forth in claim 6 wherein said quick change assembly includes a plurality of balls disposed in an aperture of said guide member and engaging and disengaging said groove of said punch to retain and release said punch in said quick change assembly.

8. A punch assembly as set forth in claim 1 wherein said quick change assembly includes a bracket attached to said rod and having a slot therein to receive said head of said punch.

9. A punch assembly as set forth in claim 8 wherein said quick change assembly includes said punch having a flat on said shaft.

10. A punch assembly as set forth in claim 9 wherein said quick change assembly includes a block for mounting to the hydroforming die to engage said flat on said punch to prevent said punch from rotating.

11. A punch assembly as set forth in claim 10 wherein said quick change assembly includes a fastener for removably securing said block to the hydroforming die.

12. A punch assembly as set forth in claim 1 wherein said quick change assembly includes a coupling attached to said rod and having a head extending radially.

13. A punch assembly as set forth in claim 12 wherein said quick change assembly includes a bracket having a first slot therein to receive said head of said coupling and a second slot therein to receive said head of said punch.

14. A punch assembly as set forth in claim 13 wherein said bracket has a tongue extending therefrom.

15. A punch assembly as set forth in claim 14 wherein said quick change assembly includes a block for mounting to the hydroforming die to engage said tongue on said bracket to prevent said bracket from rotating.

16. A punch assembly as set forth in claim 15 wherein said quick change assembly includes a fastener for removably securing said block to the hydroforming die.

17. A hydroforming punch assembly comprising:

an upper die half having a die forming cavity and a cavity extending axially therein and communicating with said die forming cavity;

a punch cylinder operatively supported by said upper die half and having a movable rod extending into said cavity;

a punch disposed in said cavity for piercing an opening in a tubular member disposed in said die forming cavity; and a quick change assembly interconnecting said rod of said punch cylinder and said punch for allowing said punch to be removably attached to said punch cylinder;

wherein said quick change assembly comprises a quick change cylinder supported by said rod of said punch cylinder, wherein said quick change cylinder includes a guide member extending axially and having one end attached to said rod, a cylinder wall disposed about said guide member to form a chamber, and a movable piston disposed within said chamber, a spring disposed within said chamber to urge said piston toward said rod, and a plurality of balls disposed in an aperture of said guide member and engaging and disengaging said punch to retain and release said punch in said quick change assembly.

18. A hydroforming punch assembly comprising:

an upper die half having a die forming cavity and a cavity extending axially therein and communicating with said die forming cavity;

a punch cylinder operatively supported by said upper die half and having a movable rod extending into said cavity;

a punch disposed in said cavity for piercing an opening in a tubular member disposed in said die forming cavity; and a quick change assembly interconnecting said rod of said punch cylinder and said punch for allowing said punch to be removably attached to said punch cylinder;

wherein said quick change assembly comprises a bracket attached to said rod and having a slot therein to receive a head of said punch, said punch having a flat on said shaft, a block mounted to said upper die half to engage said flat on said punch to prevent said punch from rotating, and a fastener removably securing said block to said upper die half.

19. A hydroforming punch assembly comprising:

an upper die half having a die forming cavity and a cavity extending axially therein and communicating with said die forming cavity;

a punch cylinder operatively supported by said upper die half and having a movable rod extending into said cavity;

a punch disposed in said cavity for piercing an opening in a tubular member disposed in said die forming cavity; and a quick change assembly interconnecting said rod of said punch cylinder and said punch for allowing said punch to be removably attached to said punch cylinder;

wherein said quick change assembly comprises a coupling attached to said rod and having a head extending radially, a bracket having a first slot therein to receive said head of said coupling and a second slot therein to receive a head of said punch, said bracket having a tongue extending therefrom, a block mounted to said upper die half to engage said tongue on said bracket to prevent said bracket from rotating, and a fastener for removably securing said block to the hydroforming die.

* * * * *